United States Patent [19]

Bolan et al.

[11] 4,304,562

[45] Dec. 8, 1981

[54] FABRIC SOFTENER ARTICLE FOR AN AUTOMATIC WASHER AND METHOD USING SAME

[75] Inventors: Joseph A. Bolan; Michael A. Grimmer, both of Cincinnati, Ohio

[73] Assignee: The Drackett Company, Cincinnati, Ohio

[21] Appl. No.: 135,830

[22] Filed: Mar. 31, 1980

[51] Int. Cl.[3] ..... D06M 13/46; A47L 13/17; C11D 17/00

[52] U.S. Cl. ..... 8/137; 427/243; 427/244; 428/260; 428/280; 428/289; 428/305.5; 206/0.5; 15/104.93

[58] Field of Search ..... 428/310, 311, 315, 260, 428/280, 289; 34/60; 427/242, 243, 244; 8/137; 252/8.6, 8.9

[56] References Cited

U.S. PATENT DOCUMENTS

| | | | |
|---|---|---|---|
| 3,633,538 | 1/1972 | Hoeflin | 427/242 |
| 3,676,199 | 7/1972 | Hewitt et al. | 428/311 |
| 3,870,145 | 3/1975 | Mizuno | 252/8.6 |
| 3,895,128 | 7/1975 | Gaiser | 427/242 |
| 3,947,971 | 4/1976 | Bauer | 34/60 |
| 3,974,076 | 8/1976 | Wiersoma et al. | 252/8.9 |
| 4,000,340 | 12/1976 | Murphy et al. | 252/8.9 |
| 4,022,938 | 5/1977 | Zaki et al. | 252/8.9 |
| 4,049,858 | 9/1977 | Murphy | 252/8.9 |
| 4,057,673 | 11/1977 | Falivene | 427/242 |
| 4,105,813 | 8/1978 | Mizuno | 428/310 |
| 4,142,978 | 3/1979 | Murphy | 427/242 |
| 4,156,592 | 5/1979 | Wood | 8/137 |
| 4,167,594 | 9/1979 | Schwadtke et al. | 427/242 |
| 4,170,565 | 10/1979 | Flesher et al. | 252/8.9 |
| 4,177,151 | 12/1979 | Siu et al. | 427/242 |

*Primary Examiner*—William J. Van Balen
*Attorney, Agent, or Firm*—George A. Mentis; Sharon Blinkoff

[57] ABSTRACT

A fabric conditioning article having controlled release properties comprising a porous substrate impregnated with one or more portions of a fabric softening composition consisting essentially of a softening agent and a dispersing system for the release of effective amounts of the softening composition into the aqueous medium of an automatic washing machine during the rinse cycle. Also provided are methods of treating laundry with a fabric softening composition during the rinse cycle of an automatic washer and a method for making the article.

23 Claims, 3 Drawing Figures

FABRIC SOFTENER ARTICLE FOR AN AUTOMATIC WASHER AND METHOD USING SAME

DESCRIPTION

Background of the Invention a. Field of Invention:

The present invention relates to the treatment of fabrics with compositions capable of imparting a softening quality to fabrics and more specifically to the articles and the method of achieving such results in an automatic washer. In a home laundry an article, comprised of a porous material having impregnated in a portion thereof, a fabric softening composition consisting essentially of a softening agent and a dispersing system, is added to an automatic washer at the initiation of the wash cycle. After the initiation of the wash cycle, the article will release the fabric softening composition so that sufficient amounts of the softening agent are available during the rinse cycle to effectively treat fabrics.

b. Description of the Prior Art:

Fabric softening in a home laundry has been achieved by adding a liquid solution containing a cationic fabric softening agent and a dispersing agent to an automatic washer during the rinse cycle of the machine. Addition of the softener during the rinse cycle rather than at the initiation of the wash cycle was required because the prior art softening agents are chemically incompatible with the soaps and anionic detergents used to launder fabrics. Since the softener had to be added during the rinse cycle in order to be effective, the washer had to be monitored to determine when the rinse cycle began. This made the process of adding the softener inconvenient.

In order to overcome the inconvenience of having to monitor the washer to determine when the softener should be added, articles were developed to achieve softening in the dryer whereby an article containing a premeasured amount of softener would be placed in the dryer along with the damp clothing at the initiation of the drying cycle. An example of one such article is the coated sheet article disclosed in U.S. Pat. No. 3,895,128 to Gaiser. In this article the fabric softener is coated onto a thin flexible substrate. In operation the heat and moisture of the dryer are said to cooperate to release the softener; however, there is no control over the rate at which the softener is released. Large amounts of the softener may be released at the initiation of the cycle which may tend to stain the fabrics. Further, due to the fact that the article is a thin sheet, it tends to ball up and get intertwined with the fabrics thereby aggravating the staining problem.

Various mechanical means were made to solve the problem associated with the use of impregnated or coated sheets in the dryer. An example of one of these is U.S. Pat. No. 3,870,145 to Mizuno, which discloses a sponge having a thickness greater than that of the flexible sheet, impregnated or saturated over its entire surface with a heat softenable solid fabric softener. The heat in the dryer causes the softener to melt and be released onto the fabrics by an abrading action which occurs when the fabrics come into contact with the sponge. The increase in thickness of the sponge over that of the impregnated or coated sheet keeps it from being intertwined with the fabrics, however, there still is a staining problem associated with the use of the sponge due to the fact that there is no control over the rate at which softener is released.

Another example of mechanical means used to solve the problems associated with the use of impregnated or coated sheet articles in the dryer is U.S. Pat. No. 3,947,971 to Bauer which discloses a porous packet containing a tablet formed of a solid fabric softener composition. The composition used to form the tablet consists only of the nitrogen containing compounds commonly used as fabric softeners.

Besides the mechanical means disclosed, various chemical agents have been added to the softener composition which is coated onto the sheet article in an attempt to solve the problems associated with the use of the flexible sheet articles. An example of such a solution is disclosed in U.S. Pat. No. 4,049,858 to Murphy.

To avoid the problems associated with the use of sheets in the dryer, articles have been developed for use in automatic washers. An example of one of these articles is U.S. Pat. No. 4,108,600 to Wong which discloses a fabric conditioning article that can be added to the contents of the washer at the beginning of the wash cycle and is intended to release fabric conditioning agent during the rinse cycle. The article of the Wong patent is a water insoluble closed receptacle which contains a pH control agent or electrolyte and a fabric conditioning agent in particulate form and the particles are coated with a substance which is made insolubilized and nondispersable by the pH control agent. The coated fabric conditioning agent and the pH control agent are physically separated in the article by a barrier. Dissolution of the coating and release of the fabric conditioning agent is controlled by the pH control agent. The pH control agent which controls the dissolution of the coating, dissolves during the wash cycle and is removed with the wash water. Once this happens, the coating dissolves to provide for the release of the softener during the rinse cycle.

SUMMARY OF THE INVENTION

The present invention is based on the finding that in a home laundry detergents perform most of their function during the first few minutes of the wash cycle. Therefore, the deleterious effects of adding a fabric softener article at the initiation of the wash cycle could be minimized by delaying the release of substantial amounts of the fabric softener until the detergent has performed its function. The article of the present invention has been designed to be added to a washer at the initiation of the wash cycle and to delay the release of substantial amounts of fabric softener by several minutes so that most of the softener is released in the last few minutes of the wash cycle and the first few minutes of the rinse cycle. Additionally, the article is designed to release the softener in such a manner as to avoid high local concentrations.

The present invention encompasses an article adapted for use in an automatic washing machine comprising (a) a block made of a porous, felt, layered cloth, or foam type material having between 10–100 pores per linear inch wherein the pores are at least partially open and (b) an effective amount of a fabric softening composition consisting essentially of from about 50% to about 70% by weight of a softening agent and from about 30% to 50% by weight of a dispersing system, containing at least two nonionic surfactants; wherein the fabric softening composition is impregnated into the block as one or more impregnated portions in said block, said portions extending into the interior of said block; wherein one or more segments of said impregnated portions are exposed on one or more surfaces of said block. The article is designed to function over a broad range of wash water temperatures and rinse water temperatures normally encountered in the washer.

The present invention also encompasses a method of treating fabrics in an automatic washer and a method for making the article of this invention.

The method of treating fabrics in accordance with the present invention comprises releasing a fabric softener during the rinse cycle of an automatic washer by adding the article of the present invention at the initiation of the wash cycle and leaving it in the wash through all cycles of the washer.

The method of making an article of this invention comprises the steps of taking an impregnating member such as an open ended cylinder, a funnel or the like and placing it on a side of the block, and then depressing the side with the impregnating member. Once the block is depressed liquid fabric softening composition is poured through the impregnating member so that it can enter the pores of a portion of the side of the block which is being depressed by the impregnating member. While the fabric softening composition is being added to the block the compressive force which acts to depress the block is gradually released. After the softener composition has been impregnated into the block, it is set aside until the softener composition solidifies. The fabric softening composition can be liquified by melting or by adding a solvent to it which will dissolve the composition and then evaporate after it has been added to the block.

It is an object of this invention to provide an article which can be added at the initiation of the wash cycle which will provide for the controlled release of softening agent such that a substantial amount of the softener is released generally during the last several minutes of the wash cycle and the first several minutes of the rinse cycle. This will avoid the problem of having to monitor the washing machine and it will also avoid the problem of deactivation of the laundry detergent due to high concentration of softener during the first few minutes of the wash cycle, while providing an effective amount of the softening agent to the rinse water. (The term effective amount as used herein means the amount of fabric softening composition necessary to impart a noticeable softening effect to the fabrics being treated. The effective amount best suited for any given combination of ingredients and wash parameters can be determined by routine experimentation).

It is a further object of the present invention to provide an article for use in an automatic washer which will release the fabric softening agent in such a manner that it is uniformly dispersed throughout the rinse water of the washer to avoid the problem of staining encountered by use of the prior art devices.

BRIEF DESCRIPTION OF THE DRAWINGS

Other objects, features and advantages of the present invention will become more fully apparent from the following detailed description of the preferred embodiment, the appended claims and accompanying drawing in which:

DETAILED DESCRIPTION OF THE PREFERRED EMBODIMENT

Figure 1:
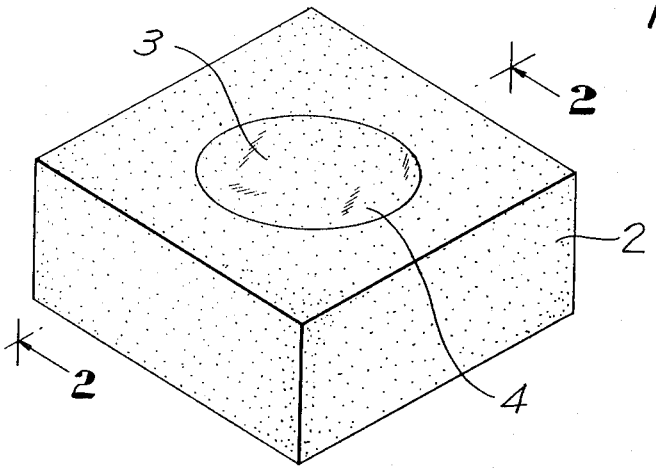
FIG. 1 is an elevated view of a preferred embodiment of the article constructed in accordance with the present invention.

With specific reference to the embodiment shown in the figures, the article of this invention includes a block 2 which is suitably in the form of a parallelepiped. Impregnated in the center of the block in this preferred embodiment are two impregnated portions in the form of dome shaped plugs of the fabric softening composition 3. The larger base surface of each of the plugs is exposed on opposite faces of the block, these exposed surfaces are 4 and 5. Between the two plugs there is a small interior portion of the block 6 which is not impregnated with the fabric softening composition.

The block of this invention can have a variety of shapes such as for example, a star, a pyramid, a sphere, or some irregular shape. It can be made from any semi-rigid porous material, which has the characteristics of being able to retard fluid flow, where at least some of the pores are open, and preferably all of the pores are open.

Examples of materials having the characteristics recited above can be selected from a wid variety of foamed materials such as polyethylene, polypropylene, cellulose, urethanes of either the ester or ether type, foamed rubbers; also felts, or layered materials forming a pad such as cloth.

The most suitable materials which are polyester polyurethane and polyether polyurethane foams having a density of about 1.75–2.00 pounds per cubic foot and having a porosity of between 30–90 pores per linear inch, where the pores are substantially open. Such materials are well known and widely available from commercial suppliers.

The fabric softening composition of the present invention consists essentially of a softening agent and a dispersing system.

The softening agent may be any of the fatty alkyl cationic softening compounds which are currently used to soften fabrics, or mixtures of these compounds. However, the softening agent must be capable of being impregnated into the block materials by the process described below and should be solid at room temperature.

The softening agents which are useful in the present invention are those organic compounds which contain a primary, secondary, tertiary or quaternary nitrogen, which have at least one relatively long hydrocarbon group containing at least 12 carbon atoms and suitable at least 16 to 22 carbon atoms. This long chain hydrocarbon group will confer hydrophobicity and lubricity. In addition to those compounds cyclical, nitrogen containing compounds such as imidazolinium salts can also be used. Further mixtures of these organic nitrogen containing compounds can also be used. Many of these organic nitrogen containing compounds are also antistatic agents.

(a) Examples of primary, secondary and tertiary nitrogen compounds that can be used in accordance with this invention include compounds having any of the following formulae:

$R_1—NH_2$;
$R_1NH—R_2$; and

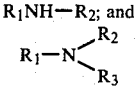

Where $R_1$ and $R_2$ may be an alkyl group having from 12 to 22 carbon atoms and $R_3$ is a lower alkyl group having from 1 to 4 carbon atoms;

(b) Examples of the quaternary nitrogen compounds or salts having the following formula:

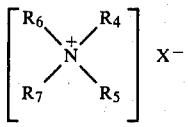

Wherein $R_6$ is an alkyl group having from 12 to 22 carbon atoms and $R_7$ is an alkyl group of from 1 to 22 carbon atoms and $R_4$ and $R_5$ are each lower alkyl groups having from 1 to 4 carbon atoms and preferably from 1 to 3 carbon atoms and $X^-$ is an anion selected from the following group:

$CH^-$, $Cl^-$, $Br^-HSO_3^-$, $SO_4^-$, $PO_4^-$, $CH_3SO_4^-$, $CH_3COO^-$

The compounds of this group which are most suitable are dimethyl distearyl ammonium methyl sulfate and dimethyl distearyl ammonium methyl chloride. Others include tallow trimethyl ammonium chloride, tallow-dimethyl (3-tallowalkoxypropyl) ammonium chloride, ditallow dimethyl ammonium chloride, ditallow dimethyl ammonium methyl sulfate, eicosyltrimethyl ammonium chloride, didodecyldimethyl ammonium chloride, tetradecyltrimethyl ammonium chloride, ditetra decyl-dimethyl ammonium chloride, pentadecyl-trimethyl ammonium chloride dihexadecyl dimethyl ammonium acetate and ditallow dipropyl ammonium phosphate;

(c) Examples of nitrogen containing imidazolinium salts having the following formula:

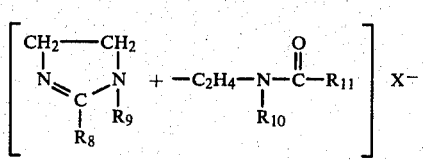

Wherein $R_8$ is alkyl having from 1 to 22 carbon atoms, $R_9$ is alkyl having from 1–4 carbon atoms, $R_{10}$ is hydrogen or alkyl having from 1 to 4 carbon atoms and $R_{11}$ is alkyl having from 8 to 22 carbon atoms and X is an anion from the group $OH^-$, $Cl^-$, $Br^-$, $HSO_3^-$, $SO_4^-$, $PO_4^-$, $CH_3COO^-$ and $CH_3SO_4^-$. The compound from this group which is most suitable is methyl-1-tallow amido ethyl-2-tallow imidazolinium methyl sulfate. Others include 1-methyl-1-[stearoylamide) ethyl]-2-heptadecyl-4, 5-dihydroimidazolinium methyl sulfate; and 1-methyl-1 [palmitoylamide)ethyl]-2-octadecyl-4, 5 dihydroimidazolinum chloride.

The amount of the softening agent present in the fabric softening composition can vary from about 50% to 70% by weight. A suitable amount for such agent is between 55% to about 65% with the most suitable amount being about 58% by weight.

The dispersing system is based on two nonionic surfactants. The system may be comprised of two nonionic surfactants each having a lower degree of alkoxylation. However, the most suitable dispersing system is comprised of two nonionic surfactants one having a higher degree of alkoxylation and the second having a lower degree of alkoxylation.

When a dispersing system comprised of two nonionic surfactants one having a high degree of alkoxylation and the other having a lower degree of alkoxylation, the surfactant with the higher degree of alkoxylation is useful to raise the melting point of the total fabric softening composition while providing enhanced solubility for the total composition. This aids in keeping the composition solid prior to being introduced into a washing machine, while insuring good solubility and therefore dispersion for the composition, once the article of this invention is added to a wash. The surfactant which has a low degree of alkoxylation provides improved dispersion for fatty substances which will aid in preventing the staining of fabrics when the article is added to a laundry.

Suitable nonionic surfactants having a higher degree of alkoxylation are for example the reaction product of one mole of a linear primary alcohol having from about 12 to 15 carbon atoms with about 12 moles of ethylene oxide (available from the Shell Chemical Company under the trade name of Neodo) 25–12, also (available from the Union Carbide Company under the trade name Tergitol 25-L-12); the reaction product of a linear primary alcohol having from about 16–18 carbon atoms with about 10.5 moles of ethylene oxide (available from the Continental Oil Company under the trade name Alfonic 1618–65; diakylphenoxypoly (ethyleneoxy) ethanol (available from the GAF Corporation under the trade name Igepal DM-970); nonylphenepoly (ethyleneoxy) ethanol (available from the GAF Corporation under the trade name Igepal CO-890); and a high molecular weight molecule having an average molecular weight of about 12,500 which is the condensation products of ethylene oxide with a hydrophobic base formed by the condensation of propylene oxide with propylene glycol (available from BASF Wyandotte Chemical Company under the trade name of Pluronic F-127). The surfactant of this group which is most suitable is the reaction product of a primary linear alcohol having from about 12 to about 15 carbon atoms with about 12 moles of ethylene oxide.

Suitable nonionic surfactants having a lower degree of alkoxylation are for example the reaction product of one mole of a tallow fatty acid having from 12 to 18 carbon atoms with from 0.5 to 7 moles of ethylene oxide or from 0.5 to 7 moles of a mixture of propylene oxide and ethylene oxide; the reaction product of one mole of an alkylphenol having from 8 to 12 carbon atoms with from 0.5 to 7 moles of ethylene oxide; and the reaction product of a linear primary alcohol having from 12 to 15 carbon atoms with 0.5 to 7 moles of ethylene oxide. The nonionic surfactant which is preferred here is the reaction product of one mole of a linear primary alcohol having from about 12 to 15 carbon atoms with 3 moles of ethylene oxide (Neodol 25–3).

The dispersing system conists of from about 30% to about 50% by weight of the fabric softening composition and suitably from about 35% to about 40% by weight thereof. When the dispersing system is comprised of two nonionic surfactants one having a high degree of alkoxylation and the other having a low degree of alkoxylation. The nonionic surfactant having a high degree of alkoxylation will comprise from about 20% to about 35% by weight of the fabric softening composition while the nonionic surfactant with a low degree of alkoxylation will comprise from about 10% to about 15% by weight of the fabric softening composition. The amounts which are most suitable are about 15% by weight of the nonionic surfactant having a low degree of alkoxylation and about 25% by weight of the nonionic surfactant having a high degree of alkoxylation.

In addition to the fabric softening composition the article of this invention can also contain various other fabric conditioning agents such as optical brighteners, perfumes, bacteriostatics, anti-resoil agents, bleach, or an enzyme containing composition. The amount of these optional ingredients can vary, from about 0.01% to about 15% by weight of the fabric softening composition.

The size of the block and the overall proportions of the impregnated portions will vary depending on the amount of the fabric softening composition and other agents, if any, which are impregnated into the block. Furthermore, although the rate at which the softener is dispersed and leached out through the pores of the block is greatly controlled by the porosity of the material of the block, substantial changes in the size of the block will also affect the rate at which the softener is dispersed and leached out of the block.

The amount of the fabric softening composition used can be varied depending on the type of fabrics being washed and the size of the wash. It has been found that generally between 1 and 10 grams of the softening agent and most suitably about 6 grams will provide noticeable softening for an average size wash. Based on the weight ratios of the dispersing system present in the fabric softening composition this would result in 1.3 to about 20 grams of the fabric softening composition being useful. The range of block sizes required to both hold this amount of the fabric softening composition and to give the desired delay in release is from about 2 to about 8 cubic inches. Further, the block must have a thickness large enough so that the fabric softening composition can be impregnated into the block. Also, to obtain release of substantial amounts of the impregnated fabric softening composition a portion of the composition should be exposed on at least one surface of the block.

Figure 2:
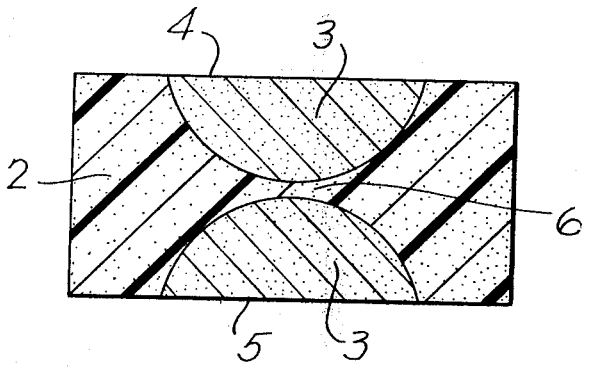
FIG. 2 is a vertical cross sectional view taken across line 2—2 of FIG. 1 of the article to illustrate the shape which the fabric softening composition takes when embedded in the block.
Figure 3:
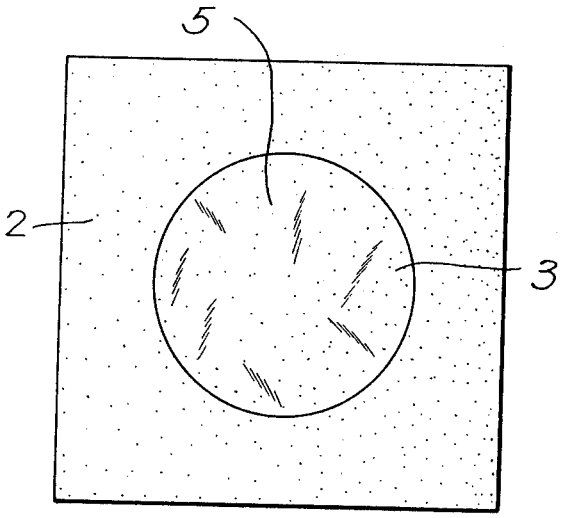
FIG. 3 is a bottom view of an article shown in FIG. 1.

Although the block can have various shapes, a suitable shape is that of a parallelepiped having the dimensions of approximately 2"×2"×1", where two approximately $1\frac{3}{4}$ inch diameter circles of the fabric softening composition are exposed on two surfaces of the block, one on each of the two square inch surfaces, and where the fabric softening composition is impregnated into the block as two somewhat dome shapped plugs as shown in FIG. 2, where a space is left between the two plugs. A most suitable material for the block is a polyurethane foam having a substantial number of open pores and having a pore size of about 80 pores per linear inch. A most suitable softener composition contains 5.9 grams of dimethyl distearyl ammonium methyl sulfate, 2.5 grams of a nonionic surfactant which is the reaction product one mole of a linear primary alcohol having between 12 and 15 carbon atoms with 12 and moles of ethylene oxide, and 1.5 grams of a nonionic surfactant which is the reaction product of one mole of a linear primary alcohol having from 12 to 15 carbon atoms with 3 moles of ethylene oxide. Additionally, a most suitable article of this invention will contain a minor amount of perfume about 1% by weight of the fabric softening composition.

A suitable embodiment of the article of this invention can be made by mixing the active softening agent with the ingredients of the dispersing system and heating half of the resultant fabric softening composition until it melts. Then an impregnating member is used to depress a central portion of one surface of the block. The liquid softener material is then added to the block through the impregnating member. While the softener is added the pressure on the block is gradually released. The article is then set aside so that the softener will solidify. After the softener has solidified, the same process of adding the fabric softening composition can be carried out on the side of the block opposite to the one already embedded, with the half of the fabric softening composition remaining.

In use the article is placed into an automatic washer before the beginning of the wash cycle along with the fabrics which are to be washed. The article will only start to dispense significant fractions of the fabric softening composition some time, such as several minutes, after the beginning of the wash cycle and will continue dispensing for several minutes into the rinse cycle, thereby supplying sufficient quantities during the rinse cycle to effectuate softening.

The delay in release of the fabric softening composition is due to the cooperation of the materials used to fabricate the block, the placement of the fabric softening composition in the block and the selection of compounds employed in the fabric softening composition.

The article of this invention is left in the washer until the conclusion of all cycles of the machine. At the conclusion of all cycles the article can be separated from the fabrics washed and discarded.

The following numbered examples further illustrate some embodiments of the invention in addition to those described heretofore.

EXAMPLE 1

A Fabric conditioning article of the present invention is made from an 80 pore per linear inch polyether polyurethane foam block having a substantial number of open pores and having the external dimensions of 2 inches×2 inches×1 inch. The article is made by impregnating 10 grams of a fabric softening composition into the block. The process which is used to impregnate the composition is as follows: Five grams of the composition is heated until it melts, an open ended cylinder is then used to depress a central portion of one of the two square inch faces of the block and the composition is then poured into the open end of the cylinder which is opposite the end of the cylinder which is in contact with the block. As the composition is poured into the cylinder the depressive force on the block is gradually released. After addition of the 5 grams to the block the block is set aside to allow the composition to solidify. Once solidified the remaining 5 grams of the composition will be melted and impregnated into the opposite 2 inch square face of the block in the same manner as described above.

The fabric softening composition contains 5.8 grams of di hydrogenated tallow dimethyl ammonium methyl sulfate, a softening agent; 4.0 grams of a dispersing system and 0.2 grams of perfume. The dispersing system is comprised of 2.5 grams of a nonionic surfactant having a high degree of alkoxylation, the reaction product of one mole of a linear primary alcohol having from 12 to 15 carbon atoms with 12 moles of ethylene oxide; and 1.5 grams of a nonionic surfactant having a low degree of alkoxylation, the reaction product of one mole of a linear primary alcohol having from 12 to 15 carbon atoms with 3 moles of ethylene oxide.

This article when added to an automatic washer along with soiled clothing and a laundry detergent at the beginning of a wash cycle will give excellent fabric softening to the articles of clothing laundered and will not result in a noticeable reduction in cleaning.

EXAMPLE 2

A fabric conditioning article of the present invention is made from a 60 pore per linear inch polyester polyurethane foam having a substantial number of open pores and having the external dimensions of 2 inches by 1 inch by 1 inch. The article is made by impregnating 5 grams of a fabric softening composition into the block in the same manner as described in Example 1.

The fabric softening composition contains 3.4 grams of dimethyl distearyl ammonium methyl sulfate, a softening agent; 1.5 grams of a dispersing system; and 0.1 grams of a perfume. The dispersing system is comprised of 0.96 grams of nonionic surfactant having a high degree of alkoxylation, nonylphenoxpoly (ethyleneoxy) ethanol, and 0.54 grams of a nonionic having a low degree of alkoxylation, the reaction product of one mole of a linear primary alcohol having from 12 to 15 carbon atoms with 3 moles of ethylene oxide.

This article when added to an automatic washer at the beginning of a wash cycle along with soiled fabrics and a laundry detergent will soften the washed fabrics without noticeably affecting the cleaning.

EXAMPLE 3

A fabric conditioning article of the present invention is made from a 90 pore per linear inch polyether polyurethane foam having a substantial number of open pores and having the external dimensions of 2 inches by 2 inches by 1 inch. The article is made by impregnating 10 grams of a fabric softening composition into the block by the process described in Example 1.

The fabric softening composition contains 5.8 grams of methyl-1-tallow amido ethyl-2-tallow imadazoliniummethyl sulfate, a softening agent; 4.0 grams of a dispersing system and 0.2 grams of a perfume. The dispersing system is comprised of 2.5 grams of a nonionic surfactant having a high degree of alkoxylation, a high molecular weight molecule having an average weight of about 12,500 which is the condensation products of ethylene oxide with a hydrophobic base formed by the condensation of propylene oxide with propylene glycol; and 1.5 grams of a nonionic surfactant having a low degree of alkoxylation, the reaction of one mole of a tallow fatty acid having from 12 to 18 carbon atoms with 2 moles of ethylene oxide.

This article when added to an automatic washer along with soiled clothing and a laundry detergent at the beginning of a wash cycle will give excellent fabric softening to the clothing being laundered and will not result in a noticeable reduction in cleaning.

What we claim is:

1. A fabric conditioning article for a washing machine which comprises:

(a) a block made of a substantially porous foam, felt, or layered cloth material having from about 10 to 100 pores per linear inch wherein the pores are at least partially open;

(b) an effective amount of a fabric softening composition consisting essentially by weight of from about 50% to about 70% of a softening agent and from about 30% to about 50% of a dispersing system; wherein said dispersing system consists essentially of at least two nonionic surfactants;

wherein the fabric softening composition is impregnated into the block, in the form of one or more impregnated portions in said block; wherein said impregnated portions extend into the block; and wherein a part of each impregnated portion is exposed on a surface of the block; and whereby release of substantial amounts of the fabric softening composition is delayed until some time after the beginning of the wash cycle of the washing machine.

2. The fabric conditioning article of claim 1 wherein the block is made of foamed polyethylene, polypropylene, cellulose, polyurethane of either the ester or ether type, or foamed rubber; felt or a layered cloth.

3. The fabric conditioning article of claim 1 wherein the block is made from a polyurethane foam having a pore size of from about 30 to 90 pores per linear inch, and wherein said pores are substantially open.

4. The fabric conditioning article of claims 1, 2 or 3 wherein the softening agent is selected from the group consisting of primary, secondary, and tertiary nitrogen compounds having at least one alkyl group of from 12 to 22 carbon atoms.

5. The fabric conditioning article of claim 3 wherein the softening agent is selected from the group of compounds or salts having the formula:

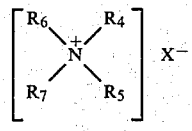

wherein $R_6$ is an alkyl having from 12 to 22 carbon atoms, $R_7$ is an alkyl of from 1 to 22 carbon atoms, and $R_4$ and $R_5$ are each lower alkyl having from 1 to 4 carbon atoms, and X is an anion selected from the group consisting of $OH^-$, $Cl^-$, $Br^-$, $HSO_3^-$, $SO_4^-$, $PO_4^-$, $CH_3COO^-$ and $CH_3SO_4^-$.

6. The article of claim 3 wherein the softening agent is selected from the group consisting of compounds or salts having the formula:

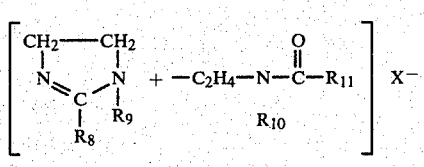

wherein $R_8$ is an alkyl having from 1 to 22 carbon atoms, $R_9$ is an alkyl having from 1–4 carbon atoms, $R_{10}$ is a hydrogen or an alkyl group having from 1 to 4 carbon atoms and $R_{11}$ is an alkyl having from 8 to 22 carbon atoms and X is an anion selected from the group consisting of $OH^-$, $Cl^-$, $Br^-$, $HSO_3^-$, $SO_4^-$, $PO_4^-$, $CH_3COO^-$, and $CH_3SO_4^-$.

7. The fabric conditioning article of claim 3 wherein the softening agent is selected from the group consisting of dimethyl distearyl ammonium chloride, methyl-1-tallow amido ethyl-2-tallow imidazolinum methyl sulfate, and dimethyl distearyl ammonium methyl sulfate.

8. The fabric conditioning article of claims 5, 6, or 7 wherein the dispersing system comprises from about 30% to 50% by weight of the fabric softening composition and wherein the dispersing system consists essentially of:

(a) From about 57% to about 72% by weight of a nonionic surfactant having a high degree of alkoxylation; and (b) from about 28% to about 43% by weight of a nonionic surfactant having a low degree of alkoxylation.

9. The fabric conditioning article of claim 8 wherein the dispersing system consists essentially of:

(a) about 62% by weight of an alkoxylate of a primary linear alcohol having from about 12 to 15 carbon atoms where one mole of the alcohol is alkoxylated with 12 moles of ethylene oxide; and (b) about 38% by weight of an alkoxylate of a primary linear alcohol having about 12 to 15 carbon atoms where one mole of the alcohol is alkoxylated with 3 moles of ethylene oxide.

10. The fabric conditioning article of claim 9 wherein the effective amount of the fabric softening composition is between about 1.3 grams and about 20 grams.

11. The fabric conditioning article of claim 10 wherein the volume of the block is from about 2 to about 8 cubic inches and the thickness of the block is ½ inch or more.

12. The fabric conditioning article of claim 11 having two impregnated portions impregnated into opposite sides of the block, wherein said impregnated portions are in the form of domes, and wherein the larger bases of said domes are exposed on opposite surfaces of said block.

13. The fabric conditioning article of claim 12 wherein the effective amount of the fabric softening composition is about 10 grams.

14. The fabric conditioning article of claim 13 wherein the block has the external dimensions of 2 inches×2 inches by 1 inch, and wherein the base of said dome shaped impregnated portions has an area equal to about 1.7 square inches, and wherein said bases are exposed on each of the two inch square faces of the block.

15. The fabric conditioning article of claim 14 wherein a portion of the block between said impregnated portions is not impregnated with the fabric softening composition.

16. A process for conditioning fabrics in an automatic washer comprising the following steps:

(a) adding to a clothes washer, along with the fabrics to be washed and a normal amount of detergent, a fabric conditioning article according to claim 1;

(b) operating said washer through all cycles.

17. The process of claim 16 wherein the block is made from a polyurethane foam having the pore sizes of about 30–90 pores per linear inch wherein the pores are substantially open.

18. The process of claim 17 wherein the softening agent is selected from the group consisting of dimethyl distearyl ammonium chloride, and methyl-1-tallow amido ethyl-2-tallow imidazolinum methyl sulfate and dimethyl distearyl ammonium methyl sulfate; wherein the fabric softening composition consists essentially by weight of from about 55% to 65% of the softening agent and from about 35% to 45% of the dispersing system.

19. The process of claim 18 wherein the dispersing system consists essentially of:

(a) about 62% by weight of an alkoxylate of a primary linear alcohol having from about 12 to 15 carbon atoms where one mole of the alcohol is alkoxylated with 13 moles of ethylene oxide; and (b) about 38% by weight of an alkoxylate of a primary linear alcohol having from about 12 to 15 carbon atoms where one mole of the alcohol is alkoxylated with 3 moles of ethylene oxide.

20. The process of claim 19 wherein the effective amount of the fabric softening composition is about 10 grams.

21. The process of claim 20 wherein the fabric conditioning article has two impregnated portions, wherein said impregnated portions are in the form of domes, and wherein the larger bases of said domes are exposed on opposite faces of said block.

22. The process of claim 21 wherein the block has the external dimensions of 2 inches×2 inches×1 inch, wherein the bases of said domes have the area of about 1.7 square inches and wherein the bases of said domes are on each of the two inch square faces of the block.

23. A process of making a fabric conditioning article which comprises the steps of:

(a) depressing one of the surfaces of a porous block with a hollow impregnating member;

(b) pouring a liquid fabric softening composition through the hollow impregnating member while gradually releasing the compressive force on the surface of the porous block, thereby causing the fabric softening composition to impregnate a portion of the porous block; and (c) then allowing the fabric softener composition to solidify;

wherein said fabric softening composition consists essentially by weight of from about 50% to about 70% of a softening agent, and from about 30% to about 50% of a dispersing system; wherein said dispersing system consists essentially of at least two nonionic surfactants.

* * * * *